United States Patent [19]

Sagawa et al.

[11] 4,399,084

[45] Aug. 16, 1983

[54] PROCESS FOR PRODUCING A FIBROUS ASSEMBLY

[75] Inventors: Yasuhiko Sagawa; Susumu Norota; Tsutomu Kiriyama; Shingo Emi; Tadasi Imoto; Tetsuo Yamauchi, all of Iwakuni, Japan

[73] Assignee: Teijin Limited, Osaka, Japan

[21] Appl. No.: 293,269

[22] Filed: Aug. 17, 1981

[30] Foreign Application Priority Data

| | | | |
|---|---|---|---|
| Aug. 18, 1980 | [JP] | Japan | 55-112637 |
| Oct. 2, 1980 | [JP] | Japan | 55-136699 |
| Mar. 31, 1981 | [JP] | Japan | 56-46344 |
| May 12, 1981 | [JP] | Japan | 56-70238 |

[51] Int. Cl.[3] ..... H05B 1/00

[52] U.S. Cl. ..... 264/27; 264/176 F; 425/72 S; 425/174.6; 425/192 S; 425/378 S

[58] Field of Search ..... 425/378 S, 382.2, 72 S, 425/460–465; 264/176 F, 27

[56] References Cited

U.S. PATENT DOCUMENTS

| | | | |
|---|---|---|---|
| 2,623,241 | 12/1952 | Mackay et al. | 425/464 |
| 2,820,985 | 1/1958 | Cresswell | 425/463 |
| 3,049,753 | 8/1962 | Ogden et al. | 425/464 |
| 3,056,163 | 10/1962 | Deis | 264/176 F |
| 3,797,982 | 3/1974 | Borrello | 425/461 |

FOREIGN PATENT DOCUMENTS

| | | | |
|---|---|---|---|
| 47-45617 | 11/1972 | Japan | 264/182 |

*Primary Examiner*—Jay H. Woo

*Attorney, Agent, or Firm*—Wenderoth, Lind & Ponack

[57] ABSTRACT

The present invention provides a process for producing a fibrous assembly, which comprises extruding a melt of a fiber-forming polymer through a mesh spinneret, said spinneret including many closely arranged small openings and having an opening ratio ($\alpha$), represented by the following formula, of at least about 10%

$$\alpha = \frac{V_a - V_f}{V_a} \times 100$$

$V_a$ is the total apparent volume of the spinneret which is taken within a unit area of its mesh portion, and $V_f$ is the total volume of partitioning members defining the small openings which is taken within a unit area of the mesh portion of the spinneret; said extrusion being carried out while generating Joule heat in the partitioning members of the spinneret and cooling the vicinity of the extrusion surface of the spinneret by supplying a cooling fluid, whereby the melt is stably converted into fine streams by the partitioning members; and taking up and solidifying the fine streams; and also provides the process wherein the extrusion surface of the spinneret is turned upward so that the normal vector of the extruding surface is reverse to the direction of gravity, and the fine streams extruded from the extrusion surface are taken up against gravity.

The present invention provides a molding apparatus for production of a fibrous assembly having a mesh spinneret which has many closely arranged small openings having an opening ratio $\alpha$ defined by the above formula of at least 10% and the extrusion surface of the spinneret being turned upwardly such that the normal vector of the extrusion surface is reverse to the direction of gravity.

16 Claims, 10 Drawing Figures

Fig. 1-a
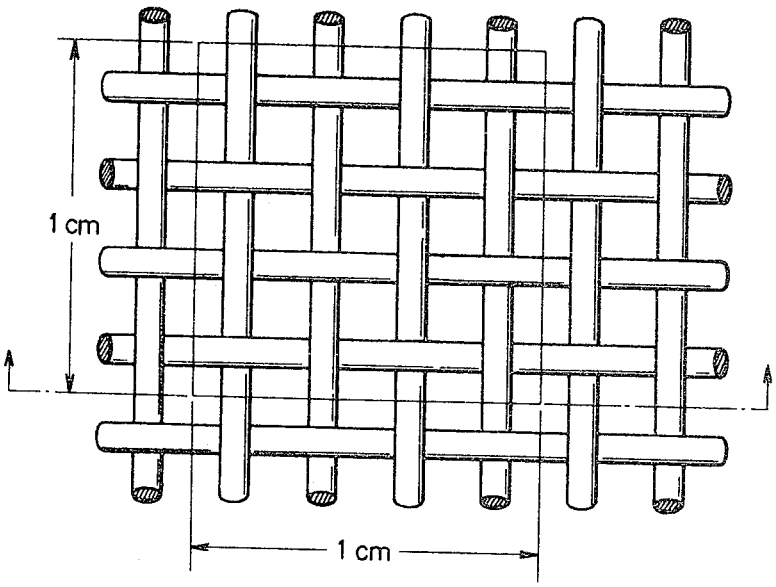
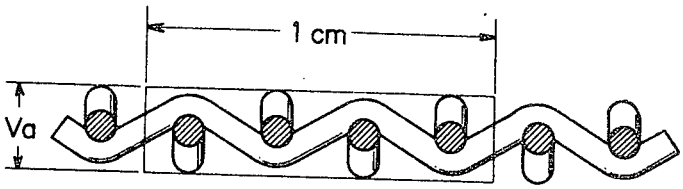
Fig. 1-b

Fig.2-a
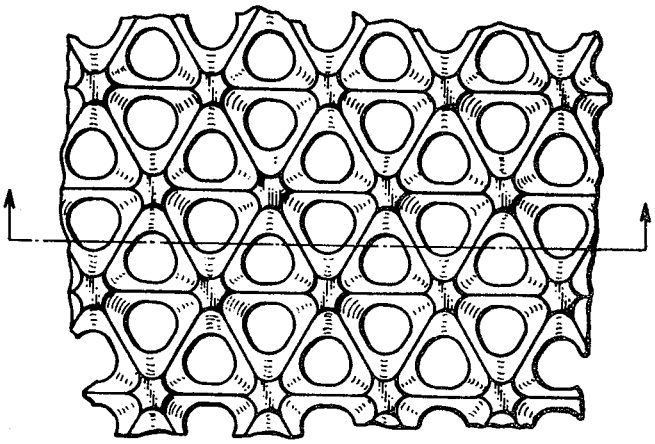
Fig. 2-b
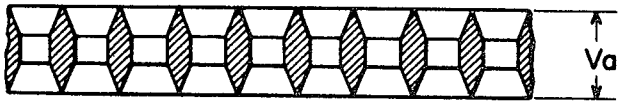
Fig. 3
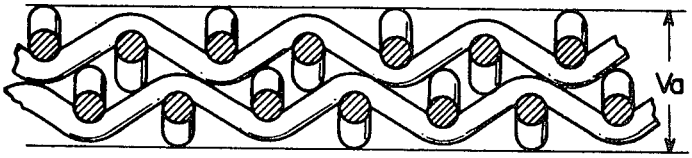

PROCESS FOR PRODUCING A FIBROUS ASSEMBLY

This invention relates to a process for producing a fibrous assembly composed of a fiber-forming polymer, and a molding apparatus therefor.

Numerous methods have heretofore been known for the production of fibrous materials from thermoplastic synthetic polymers. By the theory of production, they can be classified into those of the orifice molding type and those of the phase-separating molding type.

The former type comprises extruding a polymer from uniform regularly-shaped orifices provided at certain intervals in a spinneret, and cooling the extrudate while drafting it. This method gives fibers having a uniform and fixed cross-sectional shape conforming to the geometric configuration of the orifices.

The latter-mentioned phase-separating molding type is a method described, for example, in U.S. Pat. Nos. 3,954,928 and 3,227,664 and Van A. Wente "Industrial and Engineering Chemistry", Vol. 48, No. 8, page 1342 (1956). This method comprises extruding a molten mass or solution of a polymer through a circular nozzle or slit-like nozzle while performing phase separation so that a fine polymer phase is formed, by utilizing the explosive power of an inert gas mixed and dispersed in the molten polymer, or applying a high-temperature high-velocity jet stream to a molten mass or a solvent flash solution of polymer, or by other phase-separating means. According to this method, large quantities of a nonwoven-like fibrous assembly which is of a network structure can be obtained. The fibers which form this fibrous assembly are characterized by the fact that the cross sections of the individual fibers are different from each other in shape and size.

Commercial production of fibrous materials by these prior techniques has already been under way, and led to provision of the market with great quantities of fibrous materials. These techniques, however, have problems in regard to productivity and the adaptability of these fibrous materials to textile applications. If these problems are solved, it would be possible to provide new types of textile materials of better quality at low costs.

Some of the present inventors previously developed a process for producing fibrous materials which would give a solution to such a problem, and disclosed in copending U.S. patent application Ser. No. 133,288 filed Mar. 24, 1980, now U.S. Pat. No. 4,355,075 a process for producing a bundle of filamentary fibers which comprises extruding a melt of a thermoplastic synthetic polymer from a spinneret having numerous small openings on its polymer extruding side such that discontinuous elevations (hills) are provided between adjacent small openings, and the melt extruded from one opening can move toward and away from the melt extruded from another opening adjacent thereto or vice versa through a small opening or depression (valley) existing between said elevations; and taking up the melt extruded from the small openings of the spinneret while cooling it by supplying a cooling fluid to the polymer extruding surface of the spinneret and its vicinity to convert it into numerous fine separate fibrous streams and thus solidify them.

According to this process, fibers and an assembly thereof can be produced easily at low cost not only from highly spinnable thermoplastic polymers such as polyethylene terephthalate, but also from those thermoplastic polymers which have insufficient spinnability and which have a very high melt viscosity (e.g., polycarbonate) or exhibit a complex viscoelastic behavior (e,g., polyester elastomers, polyurethane elastomers, or polyolefin elastomers).

The present inventors have made extensive investigations in order to improve the aforesaid previously proposed process further and thus to develop a process by which fibrous assemblies can be easily produced from these fiber-forming polymers having insufficient spinnability, and by which fibrous assemblies can be produced stably from all fiber-forming polymers with higher productivity and better energy efficiency.

It is an object of this invention to provide a process by which the spinnability of fiber-forming polymers is increased, and fibrous assemblies are produced from all fiber-forming polymers stably with higher productivity and better energy efficiency.

Another object of this invention is to provide a process by which the spinnability of fiber-forming polymers is increased and therefore, fine streams of a molten polymer can be taken up from a spinneret at a higher draft ratio to produce a fibrous assembly with higher productivity.

Still another object of this invention is to provide a process for producing a fibrous assembly, by which fine streams of a polymer melt can be taken up at a higher draft from a spinneret and therefore, fibers having an increased degree of orientation can be formed.

Yet another object of this invention is to provide a process for producing a fibrous assembly from all fiber-forming polymers with higher productivity and better energy efficiency, by which heat can be applied from a spinneret to a fiber-forming polymer while it is being converted into fine streams through a spinneret and therefore high spinnability can be imparted to a polymer having low spinnability; heat in an amount required for spinning is given instantaneously to a polymer having susceptibility to decomposition thereby enabling it to be spun while preventing heat decomposition; and further an extrusion pressure exerted on the spinneret can be markedly reduced.

A further object of this invention is to provide a process for producing a fibrous assembly, in which the extrusion surface of a spinneret is turned upward and fine streams of a melt extruded through the extrusion surface are taken up upwardly against gravity, whereby the melt at the extruding surface of the spinneret is rendered uniform for all the small openings of the spinneret and fine streams can be formed with surprising stability.

An additional object of this invention is to provide a material and structure of a spinneret, and a molding apparatus for producing a fibrous assembly which has special characteristics in the direction of installation.

Other objects and advantages of the invention will become apparent from the following description.

The present invention will now be described in detail with reference to the accompanying drawings.

BRIEF DESCRIPTION OF THE DRAWINGS

FIG. 1-*a* schematically shows an example of a mesh spinneret in the process and apparatus of this invention;

FIG. 1-*b* is a partial vertical sectional view of FIG. 1-*a;*

FIG. 2-*a* schematically shows an etched porous plast as one example of another mesh spinneret different from FIG. 1-*a;*

FIG. 2-*b* shows a partial vertical sectional view of FIG. 2-*a*;

FIG. 3 schematically shows a partial vertical sectional view of a mesh spinneret composed of two superimposed wire meshes;

MANUFACTURING APPARATUS AND PROCESS

Figure 4:
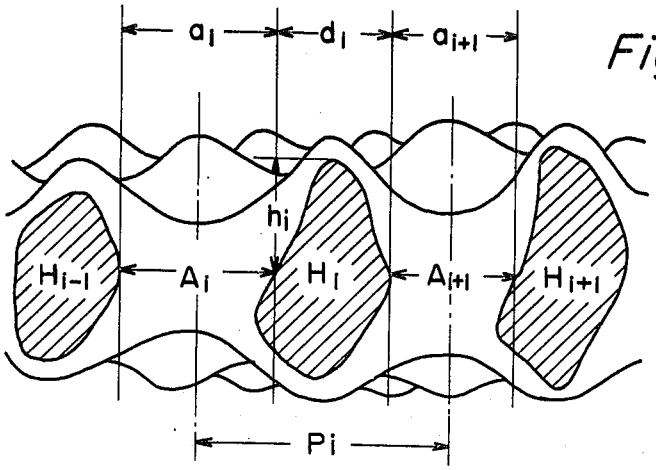
FIG. 4 is a generalized schemative view of the mesh spinneret used in this invention in its arbitrary vertical section.

According to this invention, the above objects and advantages of this invention are achieved by a process for producing a fibrous assembly, which comprises extruding a melt of a fiber-forming polymer through a mesh spinneret, said spinneret including many closely arranged small openings and having a void ratio ($\alpha$), represented by the following formula, of at least about 10%, $$\alpha = \frac{V_a - V_f}{V_a} \times 100$$

$V_a$ is the total apparent volume of the spinneret which is taken within a unit area of its mesh portion, and $V_f$ is the total volume of partitioning members defining the small openings which is taken within a unit area of the mesh portion of the spinneret; said extrusion being carried out while generating Joule heat in the partitioning members of the spinneret and cooling the extruding surface of the spinneret and its vicinity by supplying a cooling fluid, whereby the melt is stably converted into fine streams by the partitioning members; and taking up and solidifying the fine streams.

The above process is preferably achieved by turning the extruding surface of the spinneret upwardly so that the normal vector of the extrusion surface is reverse to the direction of gravity, and taking up the fine streams extruded from the extrusion surface against the gravity.

According to this invention, a fibrous assembly can be produced not only from fiber-forming polymers having good spinnability but also from fiber-forming polymers having insufficient spinnability.

Examples of polymers that can be spun in accordance with this invention are given below.

(1) Polyolefin-type and polyvinyl-type polymers

Polyethylene, polypropylene, polybutylene, polystyrene, polyvinyl chloride, polyvinyl acetate, polyacrylonitrile, polyacrylate esters, and copolymers derived from the monomeric components of these homopolymers.

(2) Polyamides

Aliphatic polyamides such as poly-ε-caprolactam, polyhexamethylene adipamide, or polyhexamethylene sebacamide, and wholly aromatic polyamides derived from structural units selected from the group consisting of dicarboxylic acid residues of the formula $$\text{-(CO—R—CO)-}$$

wherein R represents a divalent aliphatic or aromatic group, diamine residues of the formula $$\text{-(NH—R'—NH)-}$$

wherein R' represents a divalent aliphatic or aromatic group, and aminocarboxylic acid residues of the formula $$\text{-(CO—R''—NH)-}$$

wherein R'' represents a divalent aliphatic or aromatic group, in such a manner that the number of carbonyl groups (—CO—) is substaatially equal to that of amino groups (—NH—) (provided that at least 70 mole%, preferably at least 80 mole%, of the entire structural units are composed of structural units containing aromatic residues).

The divalent aliphatic group in the above formula includes groups used in the field of aliphatic polyamides such as tetramethylene, pentamethylene and hexamethylene. Examples of the divalent aromatic group are p-phenylene, m-phenylene, 1,5-naphthylene, 2,6-naphthylene, 3,3'-, 4,4'-, or 3,4'-diphenylene, and 3,3'-, 4,4'- or 3,4'-diphenyl ether. Specific examples of such aromatic polyamides include poly(p-phenylene isophthalamide), poly(m-phenylene isophthalamide), poly(m-phenylene terephthalamide), poly(1,5-naphthylene isophthalamide), poly(3,4'-diphenylene terephthalamide), and copolymers of these.

In the prior art, the aromatic polyamides are spun into fibers by a wet or dry spinning technique using an extremely limited range of aprotic polar solvents, and because of this method of spinning, the fibers obtained are of small denier sizes.

According to this invention, fibers can be produced from these aromatic polyamides by melt-spinning without substantial heat decomposition.

(3) Polyesters

Polyesters or wholly aromatic polyesters composed of a dibasic acid component which is, for example, an aromatic dicarboxylic acid such as phthalic acid, isophthalic acid, terephthalic acid, diphenyldicarboxylic acid, naphthalenecarboxylic acid, an aliphatic dicarboxylic acid such as adipic acid, sebacic acid or decanedicarboxylic acid, or an alicyclic dicarboxylic acid such as hexahydroterephthalic acid, and a glycol component which is, for example, an aliphatic glycol such as ethylene glycol, propylene glycol, trimethylene glycol, tetramethylene glycol, decamethylene glycol, diethylene glycol or 2,2-dimethylpropanediol, an alicyclic glycol such as cyclohexanedimethanol, an araliphatic glycol such as xylylene glycol, or an aromatic dihydroxy compound such as resorcinol and hydroquinone. These polyesters or a wholly aromatic polyesters may contain a hydroxycarboxyl acid component such as p-hydroxybenzoic acid. At least one of the dibasic acid components and at least one of the glycol components can be included in the above polyesters or wholy aromatic polyesters.

Examples of especially preferred polyesters are polyethylene terephthalate, polytetramethylene terephthalate, polytrimethylene terephthalate, the polyester elastomers described in U.S. Pat. Nos. 3,763,109, 3,023,192, 3,651,014 and 3,766,146, and the wholly aromatic polyesters described in U.S. Pat. Nos. 3,036,990, 3,036,991, and 3,637,595.

According to this invention, fibrous assemblies can be produced from wholly aromatic polyesters having a very high molding temperature without substantial heat decomposition.

(4) Other polymers

Polyether sulfone, polyphenylene sulfide, polycarbonates derived from variojs bisphenols, polyacetal, various polyurethanes, and fluorine-containing polymers such as polytetrafluoroethylene, polytrifluorochloroethylene, polydifluorovinylidene, a tetrafluoroethylene/hexafluoropropylene copolymer, a fluoroethylene/perfluoroalkylvinyl ether copolymer, a tetrafluoroethylene/propylene copolymer, polyvinyl fluoride, and a trifluorochloroethylene/ethylene copolymer.

According to this invention, the aforesaid fluorine-containing polymers and other polymers can be converted to fibrous assemblies without substantial decomposition.

The fiber-forming polymer may be a single polymer or an intimate microblend of two or more polymers. It is also possible to use the fiber-forming polymer as a macroblend of two or more polymers which form relatively large molten phases (copending U.S. patent application Ser. No. 288,202 filed on July 29, 1981.)

The polymer may contain plasticizers, viscosity increasing agents, etc. in order to increase plasticity for melt viscosities. The polymer may further contain usual textile additives such as light stabilizers, pigments, heat stabilizers, fire retardants, lubricants and delusterants.

The polymer needs not to be a linear polymer, and may also be a partially crosslinked polymer which exhibits fiber formability at least temporarily.

In producing the fibrous assembly in accordance with this invention, a soluble liquid medium may be incorporated in a small amount in the molten polymer. Or an inert gas or an agent capable of generating a gas may be added. When a volatile liquid medium, an inert gas or an agent capable of generating a gas is added in the process of this invention, the liquid medium or the gas explosively forms bubbles to give a fibrous assembly having an attenuated fiber cross sectional structure. The gas used in this case is preferably nitrogen, carbon dioxide gas, argon, or helium.

According to the process of this invention, the various fiber-forming polymers described above are extruded as a melt through a mesh spinneret having many closely arranged small openings having an opening ratio [$\alpha$], represented by the following formula, of at least about 10%, $$\alpha = \frac{V_a - V_f}{V_a} \times 100$$

wherein $V_a$ is the total apparent volume of the spinneret which is taken within a unit area of its mesh portion, and $V_f$ is the total volume of partitioning members defining the small openings which is taken within a unit area of the mesh portion of the spinneret, and converted into fine streams.

The spinneret used in this invention includes many closely arranged small openings defined by the opening ratio ($\alpha$). In the above formula defining the opening ratio, the mesh portion of the spinneret denotes that portion of the spinneret which is mesh-like.

So long as the spinneret used in this invention includes many closely arranged small openings defined by the above opening ratio, there is no particular restriction on the shape of the small openings, and the shapes of the partitioning members defining the small openings. Accordingly, the mesh spinneret used in this invention may have a circular, elliptical, triangular, tetragonal, or polygonal shape, or the partitioning members defining the small openings may have depressions and elevations.

FIG. 1-*a* of the accompanying drawings illustrate a typical example of the mesh spinneret used in this invention. The illustrated mesh spinneret is a plain weave wire mesh, and its cross section is shown in FIG. 1-*b*. In the plain weave wire mesh illustrated in the drawings, a small opening is of a tetragonal shape and a partitioning member defining this small opening has a depression through which a melt extruded from the small opening moves toward and away from a melt extruded from an adjacent small opening.

FIG. 2-*a* of the accompanying drawings illustrates one example of the mesh spinneret used in this invention. The illustrated mesh spinneret is an etched porous plate made by providing many small openings on a thin metallic plate by an elaborate etching technique. The etched porous plate has many small openings of a trilobal shape, as is clearly seen from its cross-sectional view shown in FIG. 2-*b*, and a partitioning member present between adjacent small openings has a depression.

The mesh spinneret used in this invention may also be a twill weave wire mesh, or a thin sintered body obtained by sintering many minute metallic balls so as to form many small openings. A part of the mesh spinneret used in this invention is disclosed in the specification of U.S. patent application Ser. No. 133,288.

The mesh spinneret in accordance with this invention may be used singly or as a laminated assembly.

The spinneret in accordance with this invention is preferably a mesh spinneret having many small openings defined by partitioning members of small width having elevations and depressions on its polymer extruding surface, said small openings being such that the polymer melt extruded through one small opening of the spinneret can move toward and away from the polymer melt extruded from another small opening adjacent to said one opening or vice versa through depressions of the partitioning members.

In the above formula defining the opening ratio ($\alpha$) of the mesh spinneret used in this invention, $V_a$ is the total apparent volume of the spinneret which is taken within a unit area of its mesh portion and $V_f$ is the total volume of partitioning members defining the small openings which is taken within a unit area of the mesh portion of the spinneret.

Again, as is seen from FIGS. 1-*a* and 1-*b*, the total apparent volume ($V_a$) is defined as a volume formed by two phantom planes of a unit area (1 $cm^2$) which contact the front and back surfaces of the spinneret.

FIG. 3 is a cross-sectional view of one example of the mesh spinneret used in this invention made by laminating two plain weave wire meshes. It will be readily appreciated that in this case, too, the total apparent volume ($V_a$) is determined by similar phantom planes to those described above.

In practice, the $V_a$ value of a certain mesh spinneret can be simply determined by measuring the thickness of the spinneret by means of a dial gauge having a contact surface of 1 $cm^2$ in area.

The $V_f$ value of a certain mesh spinneret can be determined by cutting it to a predetermined area, and for example, submerging it in a liquid, and measuring the resulting volume increase. $V_f$ is a value obtained by converting the increased volume for each $cm^2$ of the spinneret.

Since the opening ratio ($\alpha$) is expressed by the following formula $$\alpha = \frac{V_a - V_f}{V_a} \times 100$$

it will be understood that if a 1 $cm^2$ area of the spinneret is used as a standard in determined $V_a$ and $V_f$, the value showing $V_a$ is the value representing the thickness of the mesh spinneret as illustrated in FIGS. 1-*b*, 2-*b* and 3.

According to this invention, the mesh spinneret used in this invention has an opening ratio ($\alpha$) of about 20% to about 90%.

Furthermore, according to this invention, the mesh spinneret used in this invention preferably has at least 5, more preferably about 10 to about 10,000, especially preferably about 100 to about 1,000, small openings per $cm^2$.

Furthermore, according to this invention, the mesh spinneret used in this invention has a thickness of preferably not more than 10 mm, more preferably about 0.1 to about 5 mm, especially preferably about 0.2 to about 2 mm.

Advantageously, there is used in accordance with this invention a spinneret having the aforesaid structure in which the average distance ($\bar{p}$) between extrusion openings for the polymer melt on the surface of its fiber-forming area is in the range of 0.03 to 4 mm. Especially advantageously, there is used a spinneret having an extrusion surface with fine elevations and depressions and numerous small openings for polymer which have (1) an average distance ($\bar{p}$) between small openings of 0.03 to 4 mm, (2) an average hill height ($\bar{h}$) of 0.01 to 3.0 mm, (3) an average hill width ($\bar{d}$) of 0.02 to 1.5 mm, and (4) a ratio of the average hill height ($\bar{h}$) to the average hill width ($\bar{d}$), [($\bar{h}$)/($\bar{d}$)], of from 0.3 to 5.0.

The fiber-forming area, average distance (p) between small opening, average hill height (h), average hill width (d) and small openings as referred to above the defined below.

The average distance ($\bar{p}$) between small openings, average hill height ($\bar{h}$), average hill width ($\bar{d}$), etc. defined in this invention are determined on the basis of the concept of geometrical probability theory. Where the shape of the surface of the fiber-forming area is geometrically evidence, they can be calculated mathematically by the definitions and techniques of integral geometry.

For example, with regard to the fiber-forming area of a spinneret in which sintered ball-like objects with a radius of r are most closely packed, the following values are obtained theoretically.

$$\bar{p} = \sqrt{3}\ r,\ \bar{n} = \frac{\pi}{4}\ r,\ \bar{d} = \frac{\pi}{2}\ r.$$

Thus, these parameters can be theoretically determined in a spinneret whose surface is composed of an aggregation of microscopic uniform geometrically-shaped segments. Where the spinneret has a microscopically non-uniform surface shape, $\bar{p}$, $\bar{h}$, and $\bar{d}$ can be determined by cutting the spinneret along some perpendicular sections, or taking the profile of the surface of the spinneret by an easily cuttable material and cutting the material in the same manner, and actually measuring the distances between small openings, hill heights, and hill widths. In measurement, an original point is set at the center of the fiber-forming area, and six sections are taken around the original point at every 30° and measured. From this, approximate values of $\bar{p}$, $\bar{h}$, and $\bar{d}$ can be determined. For practical purposes, this technique is sufficient.

The fiber-forming area, as used in this application, denotes that area of a spinneret in which a fiber bundle having a substantially uniform density is formed. The spinneret is, for example, the one shown at 7 in FIG. 5 for preparing a fiber bundle by extruding a molten polymer.

The small opening in the spinneret denotes the first visible minute flow path among polymer extruding and flowing paths of a spinneret, which can be detected when the fiber-forming area of the spinneret is cut by a plane perpendicular to its levelled surface (mircoscopically smooth phantom surface taken by levelling the surface with fine elevations and depressions) (the cut section thus obtained will be referred to hereinbelow simply as the cut section of the fiber-forming area), and the cut section is viewed from the extruding side of the surface of the fiber-forming area.

FIG. 4 shows a schematic enlarged view of an arbitrarily selected cut section of the general fiber-forming area in this invention. In FIG. 4, $A_i$ and $A_{i+1}$ represent the small openings. The distance between the center lines of adjoining small openings $A_i$ and $A_{i+1}$ is referred to as the distance $P_i$ between the small openings. The average of $P_i$ values in all cut sections is defined as the average distance $\bar{p}$ between small openings.

That portion of a cut section located on the right side of, and adjacent to, a given extrusion $A_i$ in a given cut section which lies on the extruding side of the surface of the fiber-forming area from the $A_i$ portion is termed hill Hi annexed to $A_i$. The distance $h_i$ from the peak of hill Hi to the levelled surface of Ai is referred to as the height of hill Hi. The average of $h_i$ values in all cut sections is defined as the average hill height $\bar{h}$.

The width of the hill $H_i$ interposed between the small openings $A_i$ and $A_{i+1}$ which is parallel to the levelled surface of the spinneret $H_i$ is referred to as hill width $d_i$. The average of $d_i$ values in all cut sections is defined as average hill width $\bar{d}$.

In accordance with the above definitions, the spinneret in accordance with this invention is advantageously such that its polymer molding area, i.e. fiber-forming area, has a surface with fine elevations and depressions and numerous small openings which meet the following requirements.

(1) The average distance ($\bar{p}$) between small openings is in the range of 0.03 to 4 mm, preferably 0.03 to 1.5 mm, especially preferably 0.06 to 1.0 mm.

(2) The average hill height ($\bar{h}$) is in the range of 0.01 to 3.0 mm, preferably 0.02 to 1.0 mm.

(3) The average hill width (d) is in the range of 0.02 to 1.5 mm, preferably 0.04 to 1.0 mm.

(4) The ratio of the average hill height ($\bar{h}$) to the average hill width ($\bar{d}$), $\bar{h}/\bar{d}$, is in the range of from 0.3 to 5.0, preferably from 0.4 to 3.0.

More advantageously, in addition to prescribing the values of $\bar{p}$, $\bar{h}$, $\bar{d}$ and $\bar{h}/\bar{d}$ within the aforesaid ranges (1)

to (4), the structure of the spinneret surface is prescribed so that the value $(\bar{p}-\bar{d})/\bar{p}$ is in the range from 0.02 to 0.8, preferably from 0.05 to 0.7. The value $(\bar{p}-\bar{d})/\bar{p}$, represents the ratio of the area of a small opening within the fiber-forming area.

The greatest characteristic of the process of this invention is that the extrusion of a molten fiber-forming polymer is carried out while generating Joule heat in the partitioning members of the mesh portion and cooling the vicinity of the extrusion surface of the spinneret with a cooling fluid.

Accordingly, the partitioning members of the spinneret used in this invention are composed of a conductor material. Examples of the material are metallic elements such as platinum, gold, silver, copper, titanium, vanadium, tungsten, iridium, molybdenum, palladium, iron, nickel, chromium, cobalt, lead, zinc, bismuth, tin and aluminum; alloys such as stainless steel, nichrome, tantalum alloy, brass, phosphor bronze, and Duralmine; and non-metallic conductors such as graphite.

Figure 5:
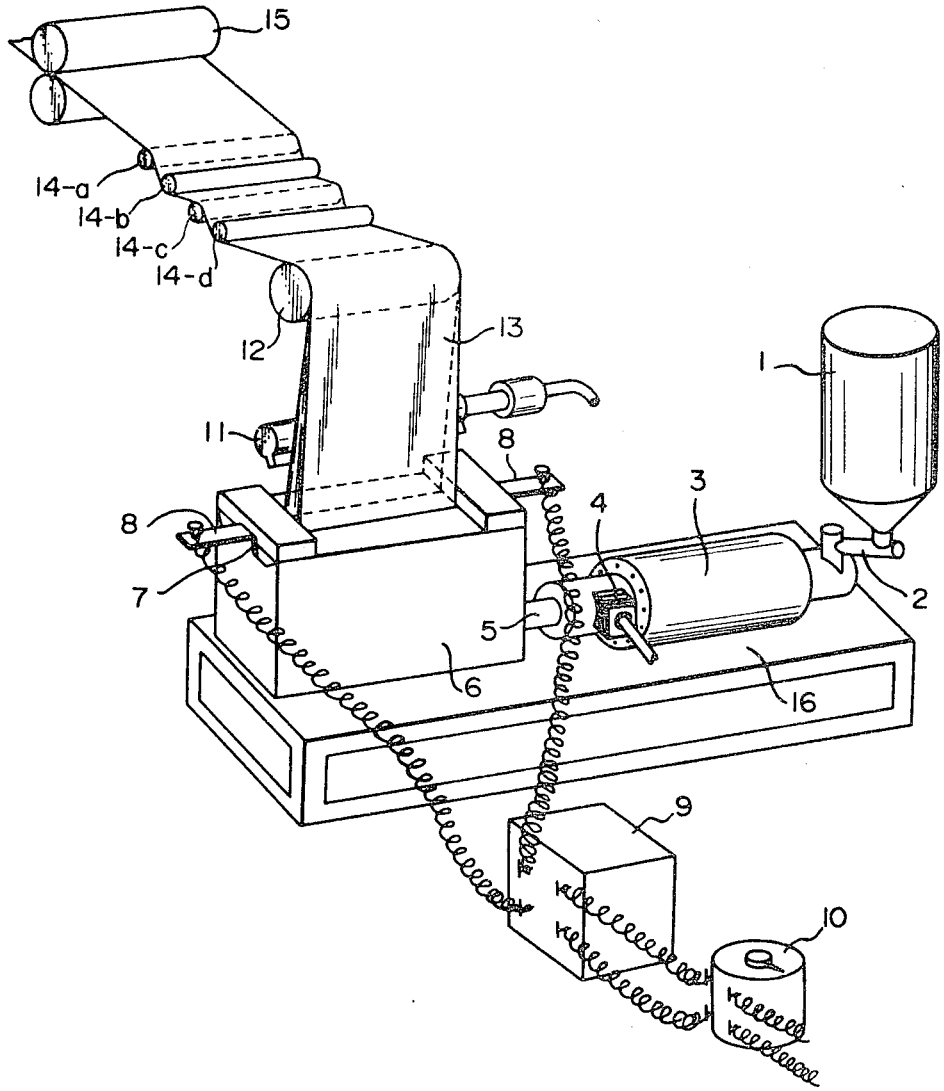
FIG. 5 is a sketch of one example of an apparatus suitable for producing a fibrous assembly in accordance with this invention.

In order to generate Joule heat in the partitioning members of the spinneret, an electric current is directly passed through the spinneret as illustrated in FIG. 5

Joule heat may be generated in the partitioning members of the spinneret by directly passing an electric current through the spinneret as illustrated in FIG. 5, or passing an electric current through a coil provided in the inside die of the spinneret to generate an eddy current. The current to be passed may be a direct current or alternate current in the case of direct supply, but in the case of generating the eddy current, it is an alternate current. According to the process of this invention, it is advantageous to supply a current directly to the spinneret because this permits simplification of the structure of the spinning apparatus.

Usually, a current of 0.1 to several hundred amperes is directly passed through the spinneret, or an electric field of 0.1 to several tens of volts/cm is applied to generate an eddy current. Thus, preferably an energy in an amount of about 0.5 to about 5,000 watts per $cm^2$ of the spinneret is imparted.

According to the process of this invention in which Joule heat is generated from the partitioning members defining the small openings of the spinneret, heat is instantaneously supplied to the fiber-forming polymer at least during its passage through the small openings in contrast to a process in which no heat is generated at the spinneret. As a result, the viscosity, temperature, etc. of the polymer melt at the extrusion surface of the spinneret can be controlled to suitable ranges so that the polymer can be smoothly separated from the extrusion surface and converted into the fine streams.

Generally, every fiber-forming polymer has a certain temperature range which is suitable for converting its melt into fine streams. This temperature range may be above the decomposition point for a certain polymer. Or since fine streams from a polymer melt having such a temperature range has a long solidification length, namely a long distance from the extrusion surface of the spinneret to a point at which the molten fine streams that have left the extrusion surface of the spinneret are solidified, it is impossible to keep converting the melt into fine streams. In other words, a suitable temperature for conversion into fine streams may be the decomposition temperature of the polymer, or the temperature at which the polymer cannot be continuously converted into fine streams stably.

The process of this invention makes it possible to give instantaneously a temperature suitable for conversion into fine streams by the partitioning members of the spinneret, and therefore, a polymer susceptible to decomposition is not decomposed at all, or at least to an extent which makes its fiberization impossible. Moreover, since according to the spinneret in accordance with this invention, the polymer melt can be converted to fine streams while supplying a cooling fluid, such as air, to the extrusion surface of the spinneret or its vicinity, the solidification length can be shortened, and the polymer melt can be continuously converted into fine streams stably.

Thus, according to the process of this invention, the solidification can be shortened, and the temperature of the fine streams can be reduced abruptly from a high temperature. It is possible therefore to increase the draft within a very short period of time over a very short distance thereby increasing the orientation of the polymer chain. This leads to the production of an assembly of as-spun fibers having a high degree of orientation.

As can be understood from the above description, the objects and advantages of the invention stated hereinabove can be advantageously achieved by the present invention.

In the process of this invention, the amount of the molten fiber-forming polymer extruded can be adjusted to about 0.1 to about 20 g/min per $cm^2$ of the mesh spinneret.

Investigations of the present inventors have shown that the process of the invention involving generating Joule heat from the partitioning members defining the small openings of the spinneret can be advantageously performed by extruding the polymer melt through the mesh spinneret while supplying Joule heat from the partitioning members such that the temperature of the fiber-forming polymer becomes maximum near that surface of the spinneret which is opposite to the extrusion surface, and while cooling the vicinity of the extrusion surface of the spinneret by supplying a cooling fluid thereto.

Figure 8:
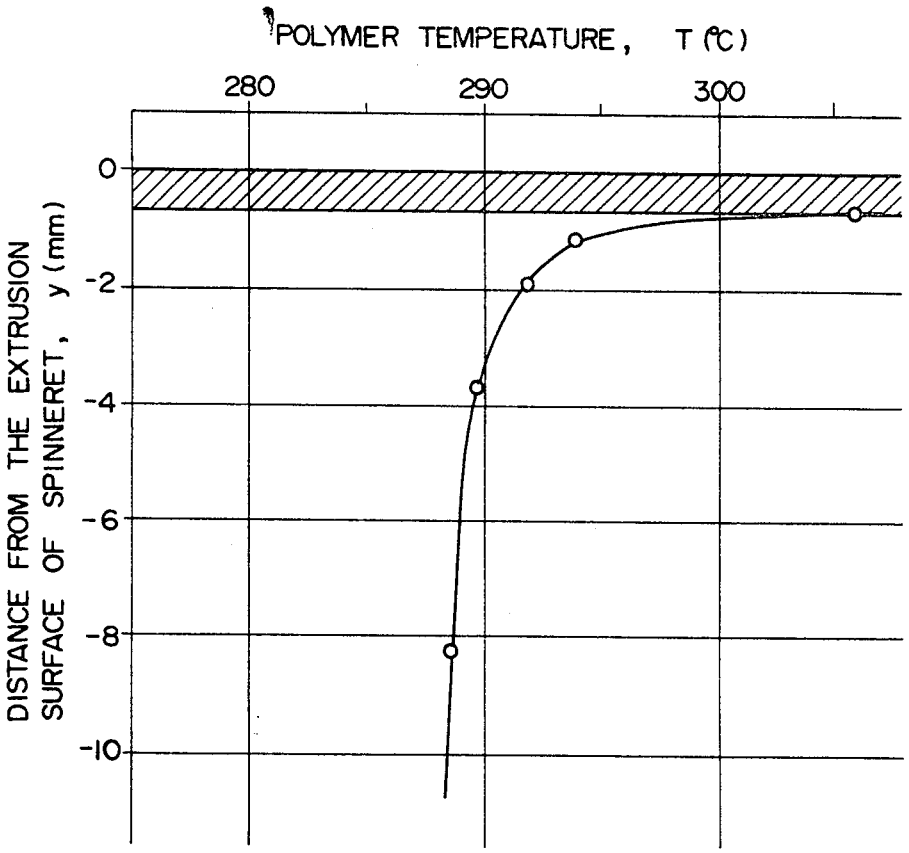
FIG. 8 illustrates one example of the relation between the temperature of a polymer and the distance from the extrusion surface of a spinneret in the practice of the process of this invention.

FIG. 8 is a temperature variation graph which shows temperature changes of molten polyethylene terephthalate which occur until the molten polymer reaches that surface of the mesh spinneret which is opposite to the extrusion surface in the spinning process of the invention, as described in detail in a specific working example given hereinbelow.

In FIG. 8, the ordinate (y) represents the distance of the molten polymer from the extrusion surface toward the opposite surface (mm, minus signs are attached because the distance reverse to the advancing direction of the molten polymer) with the extrusion surface being taken as a zero distance. The hatched portion shows the substantial thickness of the mesh spinneret. The abscissa represents the temperature (T, °C.) of the molten polymer. FIG. 8 shows that the molten polymer does not show a great temperature change to a distance of about 4 mm from the extrusion surface, then gradually attains a higher temperature as it approaches the opposite surface of the spinneret, shows an abrupt temperature rise in the vicinity of the opposite surface of the spinneret, and finally shows a maximum temperature on the opposite surface (approximately on the surface of the partitioning members). The molten polymer which has left the extrusion surface is abruptly cooled by the cooling fluid supplied to the extrusion surface or its vicinity, and shows an abrupt temperature decrease.

It is indeed surprising that according to the process of this invention, fine streams of the molten polymer can be more stably spun by turning the extruding surface of the spinneret upwardly so that the normal vector of the extrusion surface is reverse to the direction of gravity and taking up the fine streams extruded from the extrusion surface against gravity (this process is referred to herein as an "upward spinning")

Turning of a spinneret upwardly in a melt-spinning method using a conventional type of spinneret having uniform and regularly-shaped orifices at fixed intervals is described in the literature. This, however, is a mere idea, and the present inventors do not know an example in which melt spinning was actually performed while turning the extrusion surface of a spinneret upwardly. This is due presumaly to the structure of the spinneret.

The spinnert used in the process of this invention is a mesh spinnert having many closely arranged small openings defined by an open ratio ($\alpha$) of at least about 10%, and preferably a mesh spinneret having many small openings defined by partitioning members of small width having elevations and depressions on its polymer extruding surface, said small openings being such that the polymer melt extruded through one small opening of the spinneret can move toward and away from the polymer melt extruded from another small opening adjacent to said one opening or vice versa through depressions of the partitioning members.

Since the spinneret used in this invention has many closely arranged small openings, the polymer melts extruded from adjacent small openings can move toward and away from each other. In particular, when the partitioning members defining the adjacent small openings have a depressed portion, the polymer melts can more readily move toward and away from each other through the depressed portion.

It is believed that by turning the extrusion surface of the spinneret having the aforesaid characteristics upwardly in the process of this invention, gravity acting in a direction reverse to the direction of take up as fine streams causes the polymer melt extruded on the extrusion surface from adjacent small openings to move toward and away from each other in such a manner that the bottom of one fine stream taken as a hill is broadened on the extrusion surface. As a result, the supplying of the polymer melt to the individual small openings of the spinneret is more stabilized, and more stabilized spinning conditions are provided which make the shapes of the bottoms of fine streams taken as hills uniform.

Desirably, the upward spinning process of this invention is carried out by turning the extrusion surface of the mesh spinneret upwardly such that the normal vector of the extrusion surface agrees completely with the direction of a vector ($-\vec{G}$) which is quite reverse to the direction of gravity ($\vec{G}$), or is different from it by only about several degrees.

The take-up direction of the fine streams extruded from the extrusion surface in the upward spinning may be the same as, or deviated by an angle of up to about 30 degrees at most, from the normal vector direction of the extrusion surface.

According to the upward spinning process in accordance with this invention, the pressure exerted on the spinnert can be made lower than in a normal spinning performed while directing the extrusion surface of the spinnert toward in the direction of gravity, and therefore, the mechanical strength of the spinneret can be reduced. Hence, the spinneret can be produced from various materials, and the thickness of the spinneret can be made extremely thin. Accordingly, the upward spinning process using a very thin spinneret, the polymer melt before reaching the spinneret is converted into fine streams as if it were simply cut with the partitioning members of the spinneret. Accordingly, as in the case of producing an assembly of composite fibers which some of the present inventors previously proposed, it is possible to easily produce an assembly of fibers in which each fiber reflects the appearance of the molten macroblend before conversion into fine streams.

According to the upward spinning process of this invention, the solidification length of the molten polymer can be made shorter than in the case of spinning it by using a spinneret whose extrusion surface is turned in the direction of gravity. The degree of the decrease of the solidification length differs depending upon the type of the polymer, the viscosity of the molten polymer, etc. Among polymers of the same type, the solidification length of a polymer having lower viscosity can generally be made shorter. It is easy to shorten the solidification length by not more than about 10%.

Thus, according to the upward spinning process, the temperature of fine streams which have left the spinneret can be abruptly decreased over a shorter distance within a shorter period of time. Hence, it is easy to produce as-spun fibers having an increased degree of orientation.

In the molding apparatus for practicing the upward spinning process in accordance with this invention, a die provided with a spinneret can be provided on the ground or a stand provided on the ground as illustrated with reference to FIG. 5. Thus, other accessory devices can likewise be installed on the ground or in its vicinity, and a very compact apparatus can be provided in which all facilities required for spinning can be arranged at positions convenient for operation.

A series of steps for producing a fibrous assembly by the process of this invention will now be described specifically with reference to FIG. 5 which schematically shows the apparatus for performing the process of the invention. It should be understood that for simplicity, those devices and component parts which do not greatly affect the manufacturing process are omitted in FIG. 5.

FIG. 5 shows an embodiment in which a fibrous assembly is formed from a spinneret in a direction reverse to the direction of gravity. Needless to say, the process of this invention is not limited to this specific embodiment.

Referring to FIG. 5, a fiber-forming polymer is stocked in a hopper 1 from where it is supplied to an extruder 3 by means of a feeder 2. The polymer melted by the extruder is fed to an extrusion die 6 in a fixed quantity by a gear pump 4 through a conduit 5. Shown at 16 is a stand on which to install the hopper 1, extruder 3, die 6, etc. The stand 16, however, is not essential, and these devices may be installed directly on the ground.

The die 6 generally includes a heater (not shown) for maintaining the polymer in the molten state and heating it to the desired temperature. A spinneret 7 is provided on the top part of the die 6. The polymer extruding surface of the spinneret 7 is turned in a direction reverse to the direction of gravity. An electric current can be supplied to the mesh construction of the extrusion surface of the spinneret 7 through copper plates 8. Specifically, this can be achieved by connecting the current taken from a power supply to both ends of the mesh spinneret while adjusting the voltage and current by means of a transformer 9 and a slidac 10.

The molten polymer extruded from the mesh spinneret and converted into fine streams is cooled by a cooling fluid (such as air) supplied to the extrusion surface of the spinneret or to its vicinity through a feed device 11, and solidified. The solidified fibrous assembly is taken up by a take-up roller 12. The feed device 11 serves to supply the cooling fluid uniformly at a certain speed toward the extrusion surface of the mesh spinneret 7 and to its vicinity so that the molten polymer converted into fine streams may be rapidly solidified. Suitably, the feed device 11 has a nozzle or slit. Preferably, the speed and direction of the cooling fluid are determined so that the solidification length [P(s)] becomes not more than 2 cm. The solidification length [P(s)] means the distance ranging from the extrusion surface of the molten polymer to a point at which it is solidified as fibers.

The resulting fibrous assembly 13 is taken up upwardly by the take-up roller 12, and sent to a drawing step. FIG. 5 shows a drawing device consisting of a frictional guide constructed of four heated rods 14-*a*, 14-*b*, 14-*c* and 14-*d* and a pair of draw rolls 15. This is a mere example, and may be partly modified. Or another type of drawing means may be used. The drawing device shown in FIG. 5 is designed and operated such that the speed of take-up of the fibrous assembly by the draw rolls 15 is higher than that of the fibrous assembly which passes through the frictional guide (14-*a* to 14-*d*). The fibrous assembly may also be hot-drawn by passing it through a heating zone provided between the frictional guide and the draw rolls, and this is generally preferred. Heating may be effected by contacting the fibrous assembly with a hot plate, or by applying radiated heat. According to the process of this invention, therefore, the fibrous assembly in the form of an elongated strip can be formed upwardly, as shown in FIG. 5. It can be directly sent to subsequent steps, such as a drawing step, a heat-treatment step, a crimping step, a cutting step (formation of short fibers), a fiber-opening step or a web-forming step.

It will be readily understood from FIG. 5 that large quantities or fibrous assemblies can be produced by an apparatus which is on the whole very compact and simple.

The fine streams of molten polymer from the spinneret can be taken up in accordance with the process of this invention so that the packing fraction (PF) defined by the following equation becomes $10^{-4}$ to $10^{-1}$ which is much higher than that (on the order of $10^{-5}$ at most) in a conventional melt-spinning process.

$$PF=1/Da$$

wherein Da is an apparent draft ratio.

The packing fraction (PF) represents the sum of the cross-sectional areas of the entire fibers of the fiber assembly formed per unit area of the fiber-forming area of the spinneret, and constitutes a measure of the density of fibers spun from the fiber-forming area, that is, the high-density spinning property.

The apparent draft ratio (Da) is defined by the following equation.

$$Da=V_L/V_o$$

wherein $V_L$ is the actual take-up speed of the fiber assembly (cm/min.), and $V_o$ is the average linear speed (cm/min.) of the polymer melt in the extruding direction when the polymer melt is extruded so as to cover the entire extrusion surface of the fiber-forming area of the spinneret.

Figure 6:
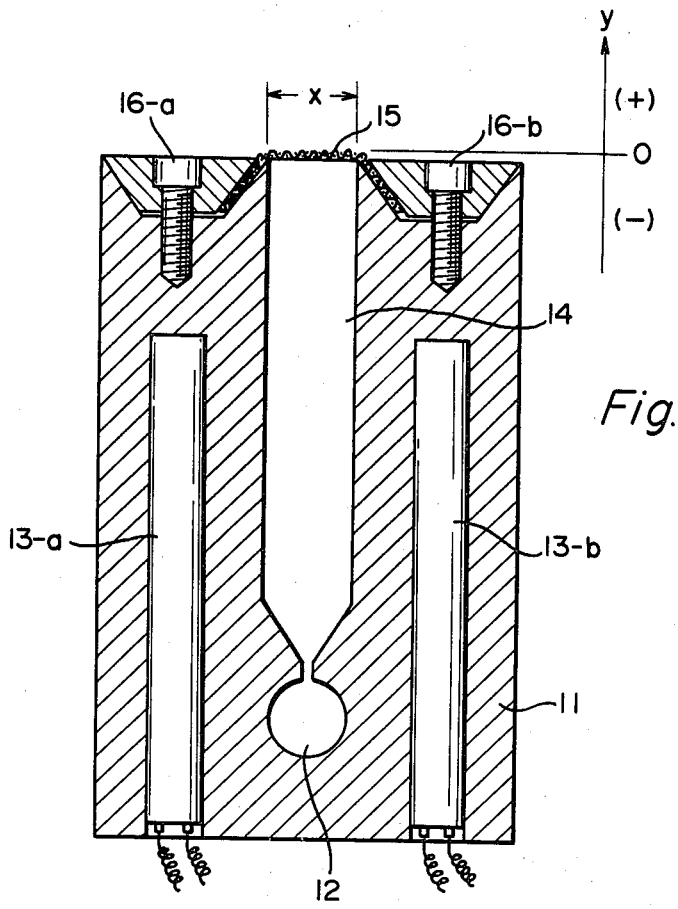
FIGS. 6 and 7 schematically show vertical sectional views of the spinneret used in the production of a fibrous assembly in accordance with this invention.

FIG. 6 is a schematic vertical sectional view of one example of the die used in the process of this invention. It should be understood that FIG. 6 shows the cross section of the die 6 shown in FIG. 5 which is taken by cutting the mesh spinneret held by copper plates at both ends, nearly at its center at right angles (vertically) when viewed from above.

In FIG. 6, the reference numeral 11 represents the die itself; 11, and 12, a flow passage of the molten polymer fed through the extruder 3, a gear pump 4 and the conduit 5 of FIG. 5. The diel 11 includes electric heaters 13-*a* and 13-*b* for maintaining the molten polymer at the desired temperature. The molten polymer which has been sent through the flow passage 12 is introduced into a reservoir 14 of the molten polymer, and then rises upwardly slowly and stably. The reservoir 14 may have mixer disposed therein in order to render the mixed condition of the polymer uniform.

Above the die 11 is installed a spinneret which is a mesh spinneret 15 in FIG. 6. An area within which the molten polymer is extruded through small openings of the mesh spinneret and formed into a fibrous assembly has a width x. The mesh spinneret is firmly secured to the die 11 by means of fastening devices 16-*a* and 16-*b*. At those parts of the mesh spinneret which are held by the fastening devices, the openings of the mesh are blocked up with an inorganic adhesive, a high-melting or thermosetting resin, etc. to prevent flowing of electric current. In FIG. 6, the direction of arrow means the direction reverse to the direction of gravity, and y=0 represent the position of the polymer extruding surface.

Cords are connected to copper plates attached to both ends (not shown) of the mesh spinneret 15 so as to permit flowing of an electric current.

Figure 7:
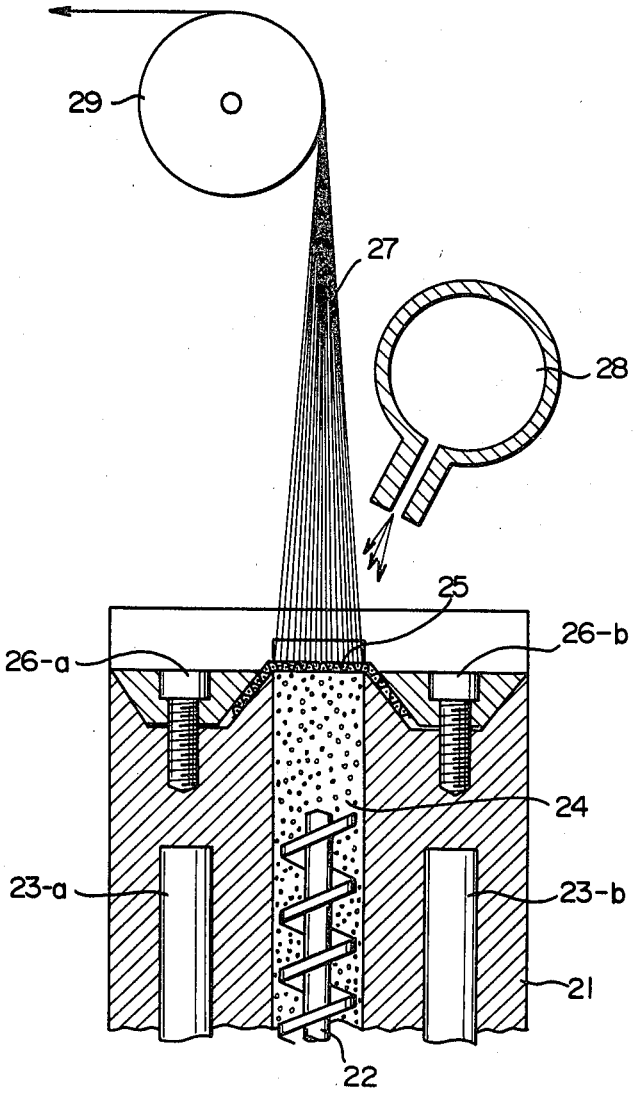

FIG. 7 shows one example embodiment (spinning apparatus) of producing a fibrous assembly from a solid powder of a fiber-forming polymer. Specifically, FIG. 7 schematically shows the longitudinal section of a die as in FIG. 6. In FIG. 7, a die 21 includes electric heaters 23-*a* and 23-*b*, and the solid powder (polymer) slowly moves upwardly through a reservoir 24. A screwtype extruder is provided in the reservoir 24 to continuously push the solid powder upwardly. Furthermore, as in FIG. 6, a mesh spinneret 25 is used, and firmly secured to the die 21 by means of fastening devices 26-*a* and 26-*b*. the fiber-forming polymer in the form of a solid powder rises through the reservoir 24, and arrives near the mesh spinneret, whereupon it is heated by Joule heat and temperarily molten. The molten polymer passes through the mesh spinneret to form fine fibrous streams. The fine streams are solidified by a cooling fluid (such as air) supplied from a feed device 28 to form a fibrous assembly. The fibrous assembly is taken up upwardly by a take-up means provided above the mesh spinneret.

By using the spinning process and apparatus shown in FIG. 7, the process of this invention can advantageously give a fibrous assembly from a solid powdery polymer very easily with which simplicity within short periods of time. This advantage cannot be obtained by conventional spinning processes. It is particularly noteworthy that the polymer is melted within a very short period of time by using the process and apparatus shown in FIG. 7. By utilizing this feature, fibers can be easily produced from polymers whose melting temperatures are close the decomposition temperatures, the melt spinning of such polymers having been previously considered impossible or difficult. Examples of such polymers include the wholly aromatic polyamides, fluorine-containing polymers, and wholly aromatic polyesters exemplified hereinabove.

Investigations of the present inventors have shown that by using the process and apparatus shown in FIG. 7, there can be simply obtained wholly aromatic polyamide fibers of relatively heavy denier which cannot at all be obtained by the conventional dry-spinning or wet-spinning of wholly aromatic polyamides, as can be seen from working examples given hereinbelow.

Thus, according to another aspect of this invention, there is provided a molding apparatus for production of a fibrous assembly comprising a mesh spinneret, a die associated with said mesh spinneret for supplying a molten fibrous fiber-forming polymer to the mesh spinneret, means for cooling the extruding surface of the spinneret and take-up means for taking up fine streams of the molten fiber-forming polymer extruded from the spinneret; characterized in that the mesh spinneret has many closely arranged small openings having an opening ratio, $\alpha$, defined by the following formula, of at least about 10%, $$\alpha = \frac{V_a - V_f}{V_a} \times 100$$

wherein $V_a$ is the total apparent volume of the spinneret which is taken within a unit area of its mesh portion, and $V_f$ is the total volume of partitioning members defining the small openings which is taken within a unit area of the mesh portion of the spinneret, the partitioning members are constructed of a conductor capable of generating Joule heat, and that the extrusion surface of the spinneret is turned upwardly such that the normal vector of the extrusion surface is reverse to the direction of gravity.

Thus, a fibrous assembly to be described in detail below is produced by the process and apparatus of this invention.

FIBROUS ASSEMBLY OF THE INVENTION

The fibrous assembly obtained by the process of this invention and the individual constituent fibers are very different from those obtained by conventional processes for fiber production, but are basically not greatly different from the fibers and their assembly (bundle) proposed previously in U.S. patent application Ser. No. 133,288 filed by some of the present inventors.

Each of the filaments constituting the fibrous assembly of this invention is characterized by having (1) a cross-sectional area varying in size at irregular intervals along its longitudinal direction, and (2) an intrafilament cross-sectional area variation coefficient [CV(F)] in the range of from 0.05 to 1.0.

The intrafilament cross-sectional area variation coefficient [CV(F)], as referred to herein, denotes a variation in the denier size of each filament in its longitudinal direction (axial direction), and can be determined as follows:

Any 3 cm-length is selected in a given filament of the fiber assembly, and the sizes of its cross-sectional areas taken at 1 mm intervals were measured by using a microscope. Then, the average $(\overline{A})$ of the sizes of the sizes of the thirty cross-sectional areas, and the standard deviation $(\sigma_A)$ of the thirty cross-sectional areas are calculated, and CV(F) can be computed in accordance with the following equation.

$$CV(F) = \sigma_A / \overline{A}$$

Each of the filaments which constitutes the fiber assembly of this invention suitably has a CV(F) of 0.05 to 1.0, especially 0.08 to 0.7, above all 0.1 to 0.5.

Such a characteristic feature of the filament of this invention is believed to be attributed to the process of this invention which quite differs from conventional melt-spinning methods.

The filaments which constitute the fiber assembly of this invention are characterized by having a non-circular cross section.

A further feature of this invention is that the filament has a non-circular cross section irregularly varying in size at irregular intervals along its longitudinal direction, and incident to this, the shape of its cross section also varies.

The degree of non-circularity of the filament cross section can be expressed by an irregular shape factor which is defined as the ratio of the maximum distance (D) between two parallel circumscribed lines to the minimum distance (d) between them, (D/d). The filaments of this invention has an irregular shape factor (D/d) on an average of at least 1.1, and most of them have an irregular shape factor (D/d) of at least 1.2.

The measurement of D/d is shown in the copending U.S. application Ser. No. 133,288 (FIG. 13). The filament in accordance with this invention is characterized by the fact that its irregular shape factor (D d) varies along its longitudinal direction.

This filament is also characterized by the fact that in any arbitrary 30 mm length of the filament along its longitudinal direction, it has a maximum irregular shape factor difference $[(D/d)_{max} - (D/d_{min}]$, defined as the difference between its maximum irregular shape factor $[(D/d)_{max}]$ and its minimum irregular shape factor $[(D/d)_{min}]$, of at least 0.05, preferably at least 0.1.

Morphoregical properties of filaments having the aforesaid characteristic features are similar to those of natural fibers such as silk.

Furthermore, according to this invention, as-spun filaments having irregular crimps at irregular intervals along their longitudinal direction can be obtained from many polymers.

The fibrous assembly in accordance with this invention is an assembly of numerous filaments composed of at least one fiber forming polymer, and is characterized by the fact that (1) each of said filaments constituting said assembly has a variation in cross-sectional size at irregular intervals along its longitudinal direction.

(2) said each filament has an intrafilament cross-sectional area variation coefficient [CV(F)] of 0.05 to 1.0, and (3) when said assembly is cut at any arbitrary position thereof in a direction at right angles to the filament axis, the sizes of the cross-sectional areas of the individual filaments differ from each other substantially at random.

When the fibrous assembly of this invention is cut at an arbitrary position thereof in a direction at right angles to the filament axis, the intra-assembly filament cross-section variation coefficient [CV(A)] in the assembly, which represents variations in the cross sectional areas of the individual filaments, is within the range of 0.1 to 1.5, preferably 0.2 to 1.

The intraassembly filament cross-section variation coefficient [CV(A)], can be determined as follows: partial assembles composed of one hundred filament like fibers respectively are sampled from the aforesaid fibrous assembly, and their cross sections at an arbitrary position are observed by a microscope and the sizes of the cross-sectional areas are measured. The average value (A) of the cross sectional areas and the standard deviation ($\sigma_A$) of the 100 cross-sectional areas were calculated. CV(A) can be computed in accordance with the following equation.

$$CV(A)=\sigma A/\overline{A}$$

The fibrous assembly in accordance with this invention is further characterized by the fact that when the assembly is cut at an arbitrary position thereof in a direction at right angles to the filament axis, the cross sections of the individual filaments have randomly and substantially different sizes and shapes.

When the above assembly is cut at an arbitrary position thereof in a direction at right angles of the filament axis, the cross-section of each filament is non-circular, and each cross section has an irregular shape factor (D/d), as defined hereinabove, of at least 1.1, and mostly at least 1.2, on an average. Furthermore, the aforesaid maximum difference in irregular shape factor $[(D/d)_{max}-(D/d)_{min}]$, as defined hereinabove, of the assembly is at least 0.05, preferably at least 0.1.

A preferred fibrous assembly is an assembly of filaments composed of a fiber-forming polymer, in which when the individual filaments of the assembly are cut in a direction at right angles to the fiber axis, their cross sections have different shapes and sizes, and moreover have the following characteristics in accordance with the definitions given in the present specification.

(i) The fibers constituting the assembly have an average denier ($\overline{D}e$) in the assembly of 0.01 to 1000 denier.

(ii) The fibers constituting the assembly have an intraassembly filament cross-sectional area variation coefficient, CV(A), of 0.1 to 1.5.

(iii) The intrafilament cross-sectional area variation coefficient [CV(F)] in the longitudinal direction of the fibers constituting the bundle is 0.05 to 1.0.

The average denier size ($\overline{D}e$) in the assembly can be determined as follows: Ten assembly each consisting of 100 fibers are sampled at random from the assembly (for simplicity, three such assembly will do; the results are much the same in both cases), and each assembly is cut at one arbitrary position in the axial direction of filament in a direction at right angles to the filament axis. The cross section is then photographed through a microscope on a scale of about 2000 times. The individual filament cross sections are cut off from the resulting photograph, and their weights are measured. The total weight is divided by the total number of the cross-sectional microphotographs, and the result [m(A)] is calculated for denier (de).

Accordingly, the average denier size ($\overline{D}e$) in the assembly is calculated in accordance with the following equation.

$$\overline{D}e=K\cdot m(A)$$

wherein m(A) is the weight average value of the photographic fiber cross sections cut off; and K is a denier calculating factor defined by the equation $$K=\frac{9\times 10^5\cdot\rho}{\alpha\cdot\beta}$$

in which $\alpha$ is the weight (g) of the unit area of the photograph, $\beta$ is the ratio of area enlargement of the photograph, and $\rho$ is the specific gravity of the polymer, all these values being expressed in c.g.s. units.

An assembly of fibers of wholly aromatic polyamides or fluorine-containing polymers or the individual fibers of the assembly which have the aforesaid morphological characteristics are novel. For example, the wholly aromatic polyamides are preferably poly(m-phenylene isophthalamide), poly(m-phenyleneterephthalamide), and poly(p-phenylene isophthalamide), especially preferably poly(m-phenylene isophthalamide). The fluorine-containing polymers include, for example, polytetrafluoroethylene, polytrifluorochloroethylene, a hexafluoroethylene/hexafluoropropylene copolymer, a tetrafluoroethylene/perfluoroalkylvinyl ether copolymer, and a tetrafluoroethylene/ethylene copolymer.

An assembly of fibers of polyethylene terephthalate or fluorine-containing polymers and the individual fibers constituting the assembly which have the aforesaid morphological properties and an increased birefringence ($\Delta n$) are also novel.

Preferably, the as-spun fibers of polyethylene terephthalate have a birefringence ($\Delta n$) of at least $1\times 10^{-2}$. Furthermore, these fibers have a degree of orientation, determined by X-rays, of at least 60% which has a correlation with the increase or decrease of the birefringence ($\Delta n$). Such as-spun fibers of polyethylene terephthalate have a boiling water shrinkage (Sh) of at least 20%, preferably at least 30%. Furthermore, such polyethylene terephthalate as-spun fibers have a degree of crystallization, determined by broad angle X-ray diffraction, of at least 3%, preferably at least 5%.

The following Examples illustrate the present invention in greater detail.

The various data obtained in these examples are measured by the following methods.

Measurement of the polymer temperature in a die:

An exposed thermocouple having a detecting section with a diameter of 0.3 mm is inserted from the undersurface of the spinning head and contacted with the back side of the spinneret. The extruding surface of the spinneret is taken as a zero point, and by moving the thermocouple from this position, temperatures (to be read by the thermocouple) in a steady state at various positions are measured. At the back side of the spinneret, a direction away from the spinneret is regarded as a negative direction.

Calculation of the amount of electricity passed:

A voltage (V) and a current (I) to be applied entirely to that portion of the mesh spinneret which generates Joule heat are measured by a voltmeter and an amperemeter which are commercially available. For example, in referring to FIG. 5, the voltage (V) and the current (I) between the copper plates 8 are measured, and then the entire area (So) of that portion in which an electric current is flowing is measured.

The amount of electricity charged ($\epsilon$) is calculated from the following equation.

$$\epsilon = \frac{V \times I}{So} \text{ (watts/cm}^2\text{)}$$

Measurement and definition of the maximum apparent draft (Da, max):

The take-up speed of the fibrous assembly is gradually increased, and the velocity ($V_L$) at which fibers corresponding to more than 70% of the molding area are broken is determined. Da calculated by using the velocity $V_L$ is defined as the Da, max.

Measurement of tenacity and elongation:

From the resulting fibrous assembly, partial assemblies each having a size of about 300 denier are sampled at random, and a stress-strain curve is drawn on a chart with a gauge length of 4 cm and at an elongating speed of 4 cm/min. and a record paper speed of 10 cm/min. A break point is determined from the curve, and the strength at break (g) and the elongation at break (%) are read for all the samples. Tenacity T(g/de) and elongation El (%) values of these are averaged. The break point is defined as that point which gives the highest maximum strength in the stress-strain curve.

Measurement of boiling water shrinkage (Sh):

From the resulting fibrous assembly, five partial assemblies each having a size of about 3,000 denier were sampled at random. A tension of 0.05 g/de is applied, and the initial length ($l_0$) and the length ($l_1$) after the treatment are measured. Sh (boiling shrinkage) is calculated from the following equation and an average value is determined.

The treatment is carried out by dipping the sample for 10 minutes in boiling water at 100° C. The length ($l_1$) after the treatment is calculated after the treated sample has been air-dried at room temperature for 12 hours.

$$Sh = 100 \times (l_0 - l_1)/l_0 \text{ (\%)}$$

The following examples illustrate the present invention more specifically without any intention of limiting the invention thereby.

All parts in the following examples are by weight.

EXAMPLES 1 TO 3 AND COMPARATIVE EXAMPLES 1 TO 3

There was used a plunger-type extruder including a barrel with an inside diameter of 10 mm and a length of 100 mm and a plunger with a diameter of 10 mm. A mesh spinneret was secured to the lower part of the barrel. In order to prevent leakage of polymer, small openings existing at those portions which are other than the part corresponding to the undersurface of the barrel were filled with an inorganic adhesive. Copper plates connected to a transformer were attached to the opposite ends of the mesh spinneret so that an electric current could be supplied to the mesh portion of the spinneret. A cooling air nozzle was provided near the surface of the spinneret.

Using the apparatus described above, polyarylate (PAr for short) having an inherent viscosity of 3.2 and derived from 40 parts of hydroquinone, 60 parts of p-hydroxybenzoic acid and 40 parts of isophthalic acid, poly(m-phenylene isophthalamide) (PMIA for short), or polytetrafluoroethylene (PTFE for short) was fiberized while passing an electric current to the spinneret).

The inherent viscosity of PAr was determined by dissolving the polymer in ortho-chlorophenol in a concentration of 0.5 g/100 ml, measuring its viscosity at 50° C. by a capillary viscometer, and then performing computation in accordance with the following equation.

The inherent viscosity of PMIA was determined by dissolving the polymer in conc. sulfuric acid in a concentration of 0.5 g/100 ml, measuring the viscosity at 30° C. by a capillary viscometer, and performing computation in accordance with the following equation:

$$\text{Inherent viscosity} = ln\eta_{rel}/0.5$$

wherein $\eta_{rel}$ is the ratio of the flowing time of the polymer solution to the flowing time of the solvent.

PTFE used was Teflon 7-J (powder) made by Mitsui Fluorochemical Co., Ltd.

For comparison, the fiberization was carried out in the same way as above except that no electricity was supplied to the spinneret.

The conditions and results are shown in Tables 1 and 2.

It is seen that when no electricity was supplied, (Comparative Examples 1 to 3), satisfactory fiberization could not be performed, whereas fiberization proceeded satisfactorily when the spinneret was heated by Joule heat (Examples 1 to 3).

In these Tables, t-5 represents the temperature of the inside wall of the barrel at 5 mm inwardly of the surface of the spinneret (y = −0.5 cm) (this temperature is considered to be substantially equal to the temperature of the polymer itself). $V_W$ represents the speed of cooling air in a direction parallel to the spinneret surface at 5 mm outwardly of the spinneret surface (y = 0.5 cm).

TABLE 1

| Example | 1 | 2 | 3 |
|---|---|---|---|
| Polymer | PTFE | PAr | PMIA |
| Spinneret | | | |
| Type | Plain weave wire mesh (stainless steel) | Sintered balls (brass) | Plain weave wire mesh (stainless steel) |
| Structure | One 30-mesh spinneret + one 60-mesh spinneret (extruding surface) | Ball diameter 0.8 mm and thickness 3 mm | One 30-mesh spinneret |
| Opening ratio (α) (%) | 65 | 40 | 77 |
| Amount of electricity (ε; watts/cm²) | 100 | 30 | 100 |
| Conditions | | | |
| Polymer temperature (y = −0.5) (t-5; °C.) | 300 | 335 | 350 |
| Mass flow (Q; g/min.) | 0.1 | 1.8 | 1.0 |
| Speed of cooling air (y = 0.5) ($V_W$; m/sec) | 0.05 | 1.0 | 0.05 |
| Speed of take-up ($V_L$; cm/min.) | 50 | 300 | 10 |
| Apparent draft (Da) | 75 | 230 | 11 |
| Results | | | |
| Average single fiber denier (De) | 54 | 17 | 830 |
| Tenacity (T; g/de) | 0.15 | 4.5 | 1.0 |
| Elongation (El; %) | 10 | 12 | 30 |

TABLE 2

| | | Comparative Example | | | | | |
|---|---|---|---|---|---|---|---|
| | | 1 | | 2 | | 3 | |
| Polymer | | PTFE | | PAr | | PMIA | |
| Spinneret | Type | Same as in Example 1 | | Same as in Example 2 | | Same as in Example 3 | |
| | Structure | Same as in Example 1 | | Same as in Example 2 | | Same as in Example 3 | |
| | Opening ratio (α) (%) | 65 | | 40 | | 77 | |
| | Amount of electricity (ε; watts/cm$^2$) | 0 | | 0 | | 0 | |
| Conditions | Polymer temperature (y = −0.5) (t-5; °C.) | 300–350 | 360–400 | 335–350 | 350–370 | 350–400 | 400–450 |
| | Mass flow (Q; g/min) | 0 | 0.5–2.0 | 1.5 | 2.0 | 0 | 0.1–0.5 |
| | Speed of cooling air (y = 0.5) ($V_W$; m/sec) | 0 | 0.05 | 1.0 | 1.0 | 0 | 0 |
| | Speed of take-up ($V_L$; cm/min.) | Could not be extruded even by increasing the extruding pressure, and decomposition proceeded in the barrel | Could be extruded. But the decomposition was so vigorous that fibers could not be formed. | 50 (maximum) | Could be extruded initially. But decomposition soon became vigorous, and fiberization failed. | Could not be extruded even by increasing the extruding pressure. | Could be extruded. But decomposition was so vigorous that fibers were not formed. |
| Results | Apparent draft (Da) | | | 38 | | | |
| | Average single fiber denier ($\overline{De}$) | | | 102 | | | |
| | Tenacity (T; g/de) | | | 0.5 | | | |
| | Elongation (El; %) | | | 5 | | | |

EXAMPLES 4 TO 8 AND COMPARATIVE EXAMPLES 4 TO 8

In these examples, polypropylene (S-115 M, a tradename for a product of Ube Industries; PP for short), polyethylene terephthalate (PET for short) having an inherent viscosity of 0.95, and polybutylene terephthalate (PBT for short) having an inherent viscosity of 1.1 were used.

The inherent viscosities of these polymers were measured and computed in the same way as in Examples 1 to 3 using a solution of polymer in phenol/tetrachloroethane (5:5) in a concentration of 0.58/100 ml. at 25° C.

In Examples 4 to 8 and Comparative Example 7, an upward spinning apparatus of the type shown in FIG. 5 was used. The molten polymer was sent by an extruder 3 into an extrusion die 6, and extruded through a mesh spinneret 7 while blowing cold air against the spinneret from a nozzle 11 to give a fibrous assembly. Heating rods 14-*a* to 14-*d* shown in FIG. 5 were not employed, and the as-spun filaments were would up through a roller 12. The used die had the same structure as shown in FIG. 6.

In Comparative Examples 4 to 6 and 8, a downward spinning apparatus was used. At the same temperature as in Examples 4 to 8, the polymer was melted by the extruder, and sent into the extrusion die. It was then extruded through the mesh spinneret while blowing cooling air against the spinneret. The as-spun filaments were wound up.

The conditions and results are shown in Tables 3 and 4.

In these tables, the fiber forming area (S) represents the area of the spinneret through which the fibrous assembly was extruded. t-5 and $V_W$ were at defined with regard to Table 1.

In the tables, "100μ filtered" in regard to sintered balls means that particles having a size of more than 100 microns could not be passed through the sintered balls.

It is seen from a comparison of Examples 4 to 6 and 8 with Comparative Examples 4 to 6 and 8 respectively that when as in the process of this invention, the surface of the extruding surface of the spinneret is heated and spinning is carried out upwardly against the direction of gravity, the maximum apparent draft becomes much higher and the tenacity elongation and thermal stability of the resulting fibers were better than in the conventional process in which the surface of the extruding surface of the spinneret is not heated and spinning is carried out in the direction of gravity (downwardly).

A comparison of Example 7 with Comparative Example 7 shows that in the present invention in which the extruding surface of the spinneret is heated, the maximum speed of take-up is increased, and fibers of better properties can be obtained.

The temperatures of the polymer in the die in Example 7 were measured, and plotted in FIG. 8. It is seen from FIG. 8 that as a result of the heating of the mesh spinneret to which an electric current is supplied, the polymer temperature becomes maximum near the inside of the spinneret. In comparison with Comparative Example 7, this is clearly the reason why the maximum apparent draft can be increased.

Table 5 summarizes the intrafilament cross-sectional area variation coefficients [CV(F)], birefringences (Δn), boiling water shrinkages (Sh), degrees of crystallization by X-rays (Xcr), and average irregular shape factors (D/d) of the PET fibers obtained in Examples 6 and 7 and Comparative Examples 6 and 7.

TABLE 3

| | | | | Example | | | | |
|---|---|---|---|---|---|---|---|---|
| | | | | 4 | 5 | 6 | 7 | 8 |
| Spinneret | Filter forming area | S | cm$^2$ | 32 | 32 | 32 | 15 | 32 |
| | Type | | | Plain weave wire mesh (45 mesh) | Sintered balls (100μ filtered) | Plain weave wire mesh (45 mesh) | Plain weave wire mesh (45 mesh) | Twill weave wire mesh |
| | Thickness | Va | mm | 0.5 | 3.0 | 0.5 | 0.5 | 0.6 |
| | Opening ratio | α | % | 65.4 | 40 | 65.4 | 65.4 | 57 |

TABLE 3-continued

| | | | | Example 4 | 5 | 6 | 7 | 8 |
|---|---|---|---|---|---|---|---|---|
| Polymer used | | | | PP | PP | PET | PET | PBT |
| Conditions | Current density | $\epsilon$ | Watts/cm$^2$ | 5 | 7 | 5 | 3.2 | 4 |
| | Polymer temperature (y = −0.5) | t-s | °C. | 250 | 260 | 275 | 290 | 272 |
| | Total mass flow | W | g/min | 25 | 42 | 70 | 23 | 55 |
| | Speed of cooling air (y = 0.5) | $V_W$ | m/sec. | 7.0 | 16 | 13 | 10 | 15 |
| | Take-up speed | $V_L$ | m/min | 50 | 40 | 40 | 40 | 38 |
| | Maximum apparent draft | $Da_{max}$ | | 8000 | 3400 | 3800 | 4000 | 3900 |
| Results | Average single fiber denier | $\overline{De}$ | do | 0.7 | 1.6 | 2.4 | 1.6 | 1.2 |
| | Tenacity (assembly) | T | g/de | 1.4 | 1.0 | 1.5 | 2.1 | 1.6 |
| | Elongation (assembly) | El | % | 99 | 290 | 110 | 100 | 51 |
| | Boiling water shrinkage | Sh | % | 2.0 | 2.4 | 38 | 35 | 3.0 |

TABLE 4

| | | | | Comparative Example 4 | 5 | 6 | 7 | 8 |
|---|---|---|---|---|---|---|---|---|
| Spinneret | Fiber forming area | S | cm$^2$ | 32 | 32 | 32 | 15 | 32 |
| | Type | | | Plain weave wire mesh (45 mesh) | Sintered balls (100μ filtered) | Plain weave wire mesh (45 mesh) | Plain weave wire mesh (45 mesh) | Twill weave wire mesh |
| | Thickness | Va | mm | 0.5 | 3.0 | 0.5 | 0.5 | 0.6 |
| | Opening ratio | α | % | 65.4 | 40 | 65.4 | 65.4 | 57 |
| Polymer | | | | PP | PP | PET | PET | PBT |
| Conditions | Current density | $\epsilon$ | Watt/cm$^2$ | 0 | 0 | 0 | 0 | 0 |
| | Polymer temperature (y = −0.5) | t-5 | °C. | 250 | 260 | 275 | 290 | 272 |
| | Total mass flow | W | g/min | 25 | 42 | 70 | 23 | 55 |
| | Speed of cooling air (y = 0.5) | $V_W$ | m/sec | 6.5 | 15 | 11 | 8 | 13 |
| | Take-up speed | $V_L$ | m/min | 27 | 30 | 12 | 15 | 23 |
| | Maximum apparatus draft | $Da_{max}$ | | 4000 | 2500 | 990 | 1800 | 2500 |
| Results | Average single fiber denier | $\overline{De}$ | de | 1.1 | 2.1 | 7.7 | 4.8 | 2.1 |
| | Tenacity (assembly) | T | g/de | 1.1 | 0.85 | 0.63 | 0.82 | 0.78 |
| | Elongation (assembly) | El | % | 173 | 380 | 231 | 200 | 75 |
| | Boiling water shrinkage | Sh | % | 2.2 | 2.3 | 70.0 | 69 | 5.0 |

TABLE 5

| | Example 6 | Example 7 | Comparative Example 6 | Comparative Example 7 |
|---|---|---|---|---|
| CV (F) | 0.15 | 0.13 | 0.17 | 0.15 |
| Δn | $2.0 \times 10^{-2}$ | $2.5 \times 10^{-2}$ | $0.6 \times 10^{-2}$ | $0.5 \times 10^{-2}$ |
| Sh | 40 | 38 | 62 | 63 |
| $X_{cr}$ | 4.2 | 6.8 | 2.0 | 2.5 |
| $(D/d)_{av.}$ | 1.4 | 1.5 | 1.4 | 1.5 |

EXAMPLES 9 TO 11

Each of the fibrous assemblies obtained in Examples 4, 7 and 8 was continuously passed over five heated rods (**14-*a* to 14-*d* shown in FIG. 5**) each having a diameter of 5 cm and being made of iron whose surface was chrome-plated in a 180-mesh embossed pattern) at a speed of $V_1$, and drawn, followed by taking up at a speed of $V_2$. The results are shown in Table 6.

The drawing temperature denotes the average of the surface temperatures of the heated rods.

The drawn polyethylene terephthalate fibers obtained in Example 10 had a birefringence of 0.14 and a degree of crystallization, determined by X-ray, of 30%.

By using the drawing method described in these Examples, the undrawn fibers could be converted into drawn fibers having a stable structure suitable for practical application without causing any trouble.

TABLE 6

| Example | | | 9 | 10 | 11 |
|---|---|---|---|---|---|
| Corresponding undrawn fibers (Example No.) | | | 4 | 7 | 8 |
| Drawing temperature | $T_D$ | °C. | 100 | 140 | 130 |
| Introducing speed | $V_1$ | m/min. | 50 | 40 | 38 |
| Take-up speed | $V_2$ | m/min. | 100 | 90 | 60 |
| Draw ratio | $V_2/V_1$ | | 2.0 | 2.3 | 1.5 |
| State of drawing | | | Good | Good | Good |
| Average single fiber denier | $\overline{De}$ | de | 0.35 | 1.1 | 0.8 |
| Tenacity (assembly) | T | g/de | 3.3 | 3.5 | 2.7 |
| Elongation (assembly) | El | % | 22 | 18 | 15 |
| Boiling water shrinkage | Sh | % | 1.7 | 2.5 | 1.5 |

EXAMPLE 12

A powder of poly(m-phenylene isophthalamide) having an average particle diameter of 500 microns was fiberized by using an extruder of the type shown in FIG. 7 to which was secured a powder supplying screw 22 and one 30-mesh palin weave wire mesh of stainless steel having a wire diameter of 0.34, a thickness of 0.7 mm and an opening ratio of 77.1% as a mesh spinneret 25.

The polymer used was obtained by interfacial polymerization in an interface between tetrahydrofuran and water, and had an inherent viscosity, measured in N-methyl pyrrolidone, of 1.2.

The temperature of the polymer powder was adjusted to 340° (at which the polymer remained solid) while it advanced from a point 10 cm below the mesh spinneret to a point immediately before the mesh spinneret 25 so as to minimize decomposition of the polymer. A current of 300 watts/cm$^2$ was passed through the mesh spinneret, and the polymer was melted in a very short region, and extruded (the mass flow 8 g/cm$^2$· min.). At a point 2 cm from the spinneret surface, cooling air was blown against the cooling air feed device 28 at a speed of 0.5 m/sec, and the fibers were taken up at a speed of 30 cm/min. As a result, bristles of the polymer having an average cross-sectional area of 0.14 mm$^2$ were obtained. The bristles had a tenacity (T) of 1.0 g/de, an elongation (El) of 30%, an intrafilament cross-sectional area variation coefficient [CF(F)] of 0.25, and an average irregular shape factor (D/d) av. of 1.5

EXAMPLE 13

Polytrifluorochloroethylene (¢Daiflon", a registered trademark for a product of Daikin Kogyo Co., Ltd.) was fed in a fixed quantity from a hopper 1 of an extruder having an inside diameter of 20 mm similar to that shown in FIG. 5, and melted by an extruder 3 at a temperature of 250° to 320° C. The molten polymer was sent to a die 6 by at a rate of 18 g/min. by means of a gear pump 4, and extruded from a spinneret of a rectangular shape having a fiber forming area of about 5 cm$^2$, and taken up at 5 m/min. to give an assembly of filamentary fibers having a single fiber denier of 18 denier.

The spinneret used was a 50-mesh stainless steel plain weave wire mesh (a product of NIPPON FILCON Co., Ltd.). The spinneret was heated by passing a current of 100 A at a voltage of 3 V.

The properties of the resulting fibrous assembly are shown in Table 6.

The wire mesh had a thickness of 0.5 mm and an opening ratio of 66.5%.

EXAMPLE 14

A tetrafluoroethylene/hexafluoropropylene copolymer (Neoflon, a registered trademark for a product of Daikin Kogyo Co., Ltd.) was used, and spun into a fibrous assembly under the same conditions as in Example 13 using a die of the type shown in FIG. 6. The temperature of the extruder 3 used at this time was 320° to 380° C. The temperature of the die 6 was 360° C.

The spinneret was heated by passing an electric current at 70 A and 2 V.

The properties of the fibers obtained are shown in Table 7.

EXAMPLE 15

A tetrafluoroethylene/ethylene copolymer (Aflon COP, a registered trademark for a product of Asahi Glass Co., Ltd.) was spun into a fibrous assembly under the same conditions as in Example 13 using a die of the type shown in FIG. 6. The temperature of the extruder was 320° to 350° C., and the temperature of the die was 340° C. The voltage was 2.2 V, and the ampere was 80 A.

The properties of the fibers obtained are shown in Table 6.

TABLE 6

| Example | [CV(F)] | Average single fiber denier (de) | Tenacity (T, g/de) | Elongation (El; %) | Average D/d |
|---|---|---|---|---|---|
| 13 | 0.43 | 18 | 0.8 | 25 | 1.5 |
| 14 | 0.40 | 20 | 0.3 | 75 | 1.6 |
| 15 | 0.38 | 16 | 1.6 | 23 | 1.4 |

The average single fiber denier was obtained by using about 100 single fibers randomly sampled from the resulting fibrous assembly.

EXAMPLE 16

In an apparatus similar to that shown in FIG. 5, the temperature of the extruder having an inside diameter of 30 mm was maintained at 230° to 270° C., poly-ε-capramide (Ny-6 for short) having an inherent viscosity (measured and computed in the same way as in Examples 1 to 3 using a solution of the polymer in m-cresol at 0.58/100 ml at 25° C.) of 1.3 was continuously melted and fed into the die 6. The molten polymer was extruded at a rate of 150 g per minute from a mesh spinneret (fiber forming area 2 cm×49 cm) having an opening ratio of 50% which was made by photoetching a stainless steel plate having a thickness of 0.3 mm. The extrusion was conducted while cooling the spinneret surface with air at a speed of 10 m/min. at y=0.5 cm. The solidified fibers were taken up at a rate of 30 m/min. whereby a fibrous assembly of as-spun fibers could be wound up stably.

A current of 5 watts/cm$^2$ was supplied to the mesh spinneret.

COMPARATIVE EXAMPLE 8

The same polymer as used in Example 16 was spun at a rate of 30 m/min. by the same apparatus and spinneret as in Example 16 except that the extruding surface was turned downwardly and no electricity was supplied to the spinneret while the temperature and other conditions were maintained the same as in Example 16. Filament breakage occurred frequently in a part (especially in the boundary area) of the fiber forming area of the spinneret, and the fibrous assembly could not be wound up stably. This was due presumably to an uneven extrusion of the molten polymer and an uneven temperature of the spinneret surface.

EXAMPLE 7

A mesh spinneret having the same pattern as in Example 16, and made of cast iron was used. The spinneret had an opening ratio of 47% and a fiber forming area of 2 cm×15 cm with a minimum area of one opening on the extrusion surface being 3.1 mm$^2$. The spinneret was secured to a die having the same structure as in FIG. 6, and coils were provided on opposite sides of the extruding surface of the spinneret which was opposite to the extruding surface. Various polymers (PET, NY-6, and PBT) were each fed into the die in the same way as in Example 16. An alternate current was passed to the coils to generate an ac magnetic field and thus to generate an eddy cureent on the surface of the spinneret. Thus, while generating heat at the spinneret, the polymer was extruded through the spinneret, and taken up while blowing cooling air against the spinneret. A fibrous assembly of fibers having a single fiber denier size of 100 denier could be taken up stably over the entire molding zone.

On the other hand, when no alternate current was supplied and therefore no eddy current was generated, poor extrusion occurred locally in the boundary area of the spinneret, and the fibrous assembly could not be taken up stably over the entire molding zone. This phenomenon was especially pronounced in the case of spinning polyethylene terephthalate.

What we claim is:

1. A process for producing a fibrous assembly, which comprises extruding a melt of a fiber-forming polymer through a mesh spinneret, said spinneret including many closely arranged small openings and having an opening ratio ($\alpha$), represented by the following formula, of at least about 10%

$$\alpha = \frac{V_a - V_f}{V_a} \times 100$$

$V_a$ ($cm^3$) is the total apparent volume of the spinneret which is taken within one square centimeter of the mesh portion of the spinneret, and $V_f$ ($cm^3$) is the total volume of partitioning members defining the small openings which is taken within one square centimeter of the mesh portion of the spinneret; said extrusion being carried out while generating Joule heat in the partitioning members of the spinneret and cooling the vicinity of the extrusion surface of the spinneret by supplying a cooling fluid, whereby the melt is stably converted into fine streams by the partitioning members; and taking up and solidifying the fine streams.

2. The process of claim 1 wherein the mesh spinneret is a mesh spinneret having many small openings defined by partitioning members of small width having elevations and depressions on its extrusion surface, said small openings being such that the polymer melt extruded through one small opening of the spinneret can move toward and away from the polymer melt extruded from an other small opening adjacent to said one opening or vice versa through depressions of the partitioning members.

3. The process of claim 1 wherein the mesh spinneret has an opening ratio ($\alpha$) of about 20 to about 90%.

4. The process of claim 1 wherein the number of the small openings per $cm^2$ of the extrusion surface is at least about 5.

5. The process of claim 4 wherein the number of the small openings per $cm^2$ of the extrusion surface is about 10 to about 10,000.

6. The process of claim 1 wherein the mesh portion of the mesh spinneret has a thickness of not more than about 5 mm.

7. The process of claim 1 wherein Joule heat is generated electrically at the partitioning members of the mesh portion of the spinneret.

8. The process of claim 1 wherein the amount of electricity passed is about 0.5 to about 5,000 watts per $cm^2$ of the mesh portion of the spinneret.

9. The process of claim 1 wherein a melt of the fiber-forming polymer is supplied to the mesh spinneret and extruded through the small openings defined by the partitioning members which generate Joule heat.

10. The process of claim 1 wherein a solid powder of the fiber-forming polymer is fed into the mesh spinneret, and while melting the solid powder by the heat given by the partitioning members generating Joule heat, the molten polymer is extruded through the small openings defined by the partitioning members.

11. The process of claim 1 wherein the molten fiber-forming polymer is extruded from the spinneret while supplying Joule heat from the partitioning members of the mesh portion such that the temperature of the molten fiber-forming polymer becomes maximum near that surface of the mesh spinneret which is opposite to the extrusion surface of the mesh portion, and while cooling the vicinity of the extruding surface of the spinneret by supplying a cooling fluid.

12. The process of claim 1 wherein the amount of the molten fiber-forming polymer extruded is about 0.1 to about 20 g min. per $cm^2$ of the mesh spinneret.

13. The process of claim 1 wherein the extrusion surface of the spinneret is turned upward so that the normal vector of the extruding surface is reverse to the direction gravity, and the fine streams extruded from the extrusion surface are taken up against gravity.

14. The process of claim 13 wherein the fine streams extruded from the extruding surface are taken up in a direction normal to the extruding surface, or in a direction which is deviated by an angle of at most about 30 degrees from the normal direction of the extruding surface.

15. A process for producing a drawn fibrous assembly, which comprises passing the undrawn fibrous assembly obtained by the process of claim 1 over a frictional guide, and taking it up at a speed higher than the speed at which it is passed over the guide.

16. The process of claim 15 wherein the taking up of the fibrous assembly is carried out after it has been passed through a heating zone and drawn substantially in the heating zone.

* * * * *